US007038393B2

(12) United States Patent
Murakata et al.

(10) Patent No.: US 7,038,393 B2
(45) Date of Patent: May 2, 2006

(54) DRIVE DEVICE FOR LIGHT-EMITTING DISPLAY PANEL

(75) Inventors: Masaki Murakata, Yonezawa (JP); Toshinao Yuki, Yonezawa (JP); Kunizo Ogoshi, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 40 days.

(21) Appl. No.: 10/799,694

(22) Filed: Mar. 15, 2004

(65) Prior Publication Data

US 2004/0189560 A1 Sep. 30, 2004

(30) Foreign Application Priority Data

Mar. 31, 2003 (JP) ..... 2003-094277

(51) Int. Cl.
*G09G 3/10* (2006.01)

(52) U.S. Cl. ..... 315/169.3; 315/169.1; 315/169.2; 315/169.4; 345/84; 345/76; 345/82

(58) Field of Classification Search ..... 345/84, 345/96, 36, 44, 77, 76, 60; 315/169.1, 169.3, 315/169.2, 169.4
See application file for complete search history.

(56) References Cited

U.S. PATENT DOCUMENTS 6,175,193 B1 * 1/2001 Kishita et al. ..... 315/169.3
6,337,542 B1 * 1/2002 Hanaki et al. ..... 315/169.3
6,351,076 B1 * 2/2002 Yoshida et al. ..... 315/169.1
6,617,801 B1 * 9/2003 Ishizuka et al. ..... 315/169.3
6,707,438 B1 * 3/2004 Ishizuka et al. ..... 345/78
6,894,685 B1 * 5/2005 Ogusu et al. ..... 345/214
2002/0190934 A1 * 12/2002 Yoshida et al. ..... 345/76
2004/0189558 A1 * 9/2004 Yoshida et al. ..... 345/82

FOREIGN PATENT DOCUMENTS

JP 11-8064 1/1999

* cited by examiner

*Primary Examiner*—Trinh V. Dinh
*Assistant Examiner*—Binh Van Ho
(74) *Attorney, Agent, or Firm*—Westerman, Hattori, Daniels & Adrian, L.L.P.

(57) ABSTRACT

A drive device for a light-emitting display panel, having the more extended light-emitting life of an EL element, is provided. Drive switches SX1 to SXn select a reverse direction voltage −V immediately after starting of scanning to supply the voltage −V to all of EL elements in a scanning state. Subsequently, through the switches SX1 to SXn, constant current sources I1 to In are connected to data lines to be controlled for light emitting, and, a forward voltage +V1 (a voltage equal to or smaller than a light-emitting threshold one) is applied to data lines which do not contribute to light emitting. Thereby, the forward voltage is applied to the EL elements in a scanning state.

13 Claims, 11 Drawing Sheets

DRIVE DEVICE FOR LIGHT-EMITTING DISPLAY PANEL

BACKGROUND OF THE INVENTION

1. Field of the Invention

The invention relates to a drive device for a light-emitting display panel in which, for example, organic EL (electroluminescent) elements are used as light-emitting elements and the elements are arranged, for example, like a plane, and, more particularly, to a drive device for a passive-drive-type light-emitting display panel in which the life time of the light-emitting elements can be extended by applying a forward voltage and a reverse direction voltage to the above-described organic EL elements in a predetermined period.

2. Description of the Related Art

Development of a display using a display panel in which light-emitting elements are configured to be arranged in a matrix has been widely promoted, and organic EL elements using an organic material for a light-emitting layer have been noticed as light-emitting elements used for such a display panel. The background is that the elements which are adequate for practical use and have higher efficiency and longer life time have been realized by using an organic compound, which can be expected to have good light-emitting characteristics, for the light-emitting layer of the element.

The above-described organic EL element can be electrically expressed by an equivalent circuit shown in FIG. 1. That is, the organic EL elements can be replaced by a configuration comprising a light-emitting element E, which consists of a diode element, and a parasitic capacitance compound Cp, which is connected to the light-emitting element in parallel. Accordingly, the organic EL elements are considered to be a capacity-type light-emitting element.

When a light-emitting control voltage is applied to the organic EL element, charges equivalent to the electric capacity of the element concerned, in the first place, flows into an electrode as a displacement current and are accumulated. Successively, when a predetermined voltage (light-emitting threshold voltage=Vth) unique for the element is exceeded, a current begins to flow from an electrode (the side of an anode of the diode element E) to an organic layer forming the light-emitting layer and light is emitted with an intensity in proportion to the current, according to a thought.

FIG. 2A to FIG. 2C show static characteristics of such organic EL element. According to the characteristics, the organic EL element emits light with a luminance (L) in proportion approximately to a driving current (I) as shown in FIG. 2A, and the current (I) rapidly flows to emit light as shown in FIG. 2B when a driving voltage (V) is larger than the light-emitting threshold voltage (Vth). In other words, the current hardly flows in the EL element and light is not emitted when the driving voltage is equal to or smaller than the light-emitting threshold voltage (Vth). Therefore, in a region in which the driving current is larger than the light-emitting threshold voltage (Vth) and light can be emitted as shown by a solid line in FIG. 2C, the luminance characteristic of the EL element has a characteristic in which the light-emitting luminance (L) is increased as the value of the voltage (V) applied to the element becomes larger.

A passive-drive-type display panel in which organic EL elements are arranged in a matrix has already been put into practical use by some companies as a display panel using such organic EL element. FIG. 3 shows one example of the passive-drive-type display panel and a drive device therefor.

There are two methods for driving organic EL elements according to the passive-drive-type driving method: cathode-line scanning and anode-line drive; and anode-line scanning and cathode-line drive. The example shown in FIG. 3 is one form according to the former method of the cathode-line scanning and the anode-line drive.

That is, a display panel 1 has a configuration in which anode-lines Al to An as n pieces of data lines are arranged in the vertical direction; cathode lines K1 to Km as m pieces of scanning lines are arranged in the horizontal direction; and organic EL elements E11 to Enm, represented with symbol marks of a diode, as light-emitting elements are arranged at each intersecting place (n×m points in total).

And, in each EL element E11 to Enm forming a pixel, one end (the anode terminal of an equivalent diode to the EL element) is connected to the anode line, and the other one (the cathode terminal of the equivalent diode to the EL element) is connected to the cathode line, according to points of intersections between the anode-lines A1 to An in the vertical direction and the cathode lines K1 to Km in the horizontal direction. Moreover, the anode-lines A1 to An are connected to an anode drive circuit 2, and the cathode lines K1 to Km are connected to a cathode scanning circuit 3 for each driving.

The above-described anode-line drive circuit 2 has a configuration in which constant current sources I1 to In which is driven by a power supply voltage VH to generate a predetermined driving current and drive switches SX1 to SXn are comprised, and driving currents from the above-described constant current sources I1 to In are supplied to the anode-lines A1 to An through the drive switches SX1 to SXn, respectively.

That is, currents from the constant current sources I1 to In, respectively, are configured to be supplied to the EL elements E11 to Enm arranged corresponding to the cathode lines by selection of the side of the above-described constant current sources I1 to In with the above-described drive switches SX1 to SXn. Moreover, the anode lines are configured to be able to be connected by the above-described drive switches SX1 to SXn to the side of the ground as the reference potential point when the currents from the constant current sources I1 to In are not supplied to the individual EL elements.

On the other hand, the above-described cathode-line scanning circuit 3 has a configuration in which scanning switches SY1 to SYm are comprised corresponding to the cathode lines K1 to Km, respectively, and, for example, either of a reverse bias voltage VM obtained by dividing the above-described power supply voltage VH or the ground potential as a scanning reference point is connected to the corresponding cathode lines.

Thereby, light-emitting of each of the above-described EL elements is configured to selectively be performed by connecting the constant current sources I1 to In to the desired anode lines A1 to An, respectively, while the cathode lines are set at the scanning reference point (ground potential) with a predetermined cycle. Here, it is also possible to use a constant voltage circuit, instead of the above-described constant current source, as a driving power supply. But it is general to use the constant current source as the driving power supply, as shown in FIG. 3, because the current-luminance characteristic is stable to temperature changes, and, on the other hand, the voltage-luminance characteristic of the EL elements is unstable to the temperature changes.

Moreover, the above-described anode-line drive circuit 2 and the above-described cathode-line scanning circuit 3 are configured to display an image corresponding to image data according to the image data supplied to a light-emitting control circuit 3 by receiving instructions from the light-emitting control circuit 3 which is not shown in FIG. 3. In this case, the scanning switches SY1 to SYm are controlled in the cathode-line scanning circuit 3 to sequentially be switched so that any one of cathode lines corresponding to a horizontal scanning period of the image data is sequentially selected by an instruction from the light-emitting control circuit and is set at the ground potential as the scanning reference point and the reverse bias voltage VM is applied to other cathode lines in an non-scanning state. Here, FIG. 3 shows a state in which a second cathode line K2 is scanned and the reverse bias voltage VM is applied to other cathode lines.

There is a configuration in which the above-described reverse bias voltage VM charges the parasitic capacitance of the EL elements, which are connected to intersections with the cathode lines which have been selected for scanning, in a driving state and prevents the EL elements, which are connected to intersections between the anode lines in a driving state and the cathode lines which have been selected for scanning, from crosstalk light-emitting by leakage currents. Generally, the voltage value of the reverse bias voltage VM is set at an approximately equal value to a forward voltage vf of an EL element in a light-emitting state. Then, since the scanning switches SY1 to SYm are sequentially switched to the side of the ground potential for each horizontal scanning period, the EL elements, which have been connected to the cathode lines, can be put into a state, in which light-emitting can be performed, by the cathode lines set at the ground potential.

On the other hand, there is supplied a drive control signal from the above-described light-emitting control circuit to the above-described anode-line drive circuit 2, wherein light-emitting of any one of the EL elements connected to anode lines is performed and timing and duration of light-emitting of the EL element are controlled by the drive control signal, based on pixel information demonstrated by the image data. The above-described anode-line drive circuit 2 has a configuration in which on control of some of the drive switches SX1 to SXn to the side of the above described constant current sources I1 to In is performed in response to the drive control signal and driving currents are supplied to the EL elements through the anode lines A1 to An according to the pixel data.

Thus, light-emitting control of the EL elements to which the driving currents are supplied is performed according to the above-described image data. Here, since FIG. 3 shows the state in which the second cathode line K2 is scanned as described above and the drive switches SX2 and SX3 among the drive switches SX1 to SXn are connected to the side of the constant current sources, light-emitting control of the EL elements of E22 and E32, which are enclosed with a circle in the drawing, is performed.

Incidentally, it has been empirically known that the light-emitting life of the above-described organic EL elements can be extended by supplying the forward voltage according to the polarity of the equivalent diode and by applying the reverse direction voltage (reverse bias voltage), which does not contribute to sequential light-emitting operation, to the elements. The above point is disclosed, for example, in the Japanese Patent Application Laid-Open No. HEI-11 (1999)-8064 (paragraphs 0003 to 0005 and FIG. 2A to FIG. 2C).

Then, an operation during which anode lines which are excluded for lighting driving are connected to the side of the ground potential with the drive switches SX1 to SXn is performed in the configuration shown in FIG. 3. By the operation, the above-described reverse bias voltage can be applied to the EL elements arranged at the positions of intersections between the anode lines which are excluded for lighting driving and the cathode lines in an non-scanning state.

For example, in the state in which the second cathode line K2 is scanned for lighting driving of the elements E22 and E32 as shown in FIG. 3, the reverse bias voltage VM is applied to the cathodes through the scanning switch SY3, respectively and the anodes are connected to the side of the ground potential through the drive switches SX1 and SXn, respectively, when the elements E13 and En3 are noticed. Thereby, the reverse bias voltage of the voltage value VM is applied to the above-described elements E13 and En3, respectively. The operation during which the reverse bias voltage is applied is similarly performed when one-frame scanning is completed and the subsequent frame is scanned.

On the other hand, a case in which light-emitting of EL elements connected to specific cathode lines is not performed for a while may be generated for some pieces of data. Assuming, for example, a case in which light-emitting of EL elements connected to the third cathode line K3 is not performed for a while, the voltage of the cathode line K3 becomes the ground potential by scanning the third cathode line K3 and, at the same time, the voltages of EL elements connected to the cathode line K3 also become the ground potential. At this time, the voltages of the anodes of the EL elements connected to the above-described cathode line K3 become the ground potential through the above-described drive switches SX1 to SXn.

Accordingly, both the voltages at the anodes and those at the cathodes for the EL elements connected to the cathode line K3 become the ground potential together, there is no application of the forward voltage to the EL elements. Moreover, the above state continues over a considerable number of frames for some image data. Therefore, there is generated a problem that an effect by which the light-emitting life of the elements is extended becomes lower in a state in which there is no application of the forward voltage to the elements even if the reverse bias voltage is applied to the EL elements as described above.

SUMMARY OF THE INVENTION

This invention has been made, considering problems generated in the above-described passive-drive-type display panel on extending the light-emitting life of an EL element. The object of the invention is to provide a drive device for a light-emitting display panel in which the light-emitting life of an EL element can be extended by applying a forward bias voltage and a reverse bias one to EL elements in an alternate manner under a state in which there is actively given opportunity to apply a forward voltage to the EL elements. Additionally, the object of the invention is to-provide a drive device for a light-emitting display panel by which useless light-emitting operation of an EL element can be controlled when a forward voltage is applied to the EL element.

As disclosed in a first aspect, a drive device for a light-emitting display panel according to the invention which has been made in order to achieve the above-described object is a drive device for a light-emitting display panel having a configuration in which, under a state in which light-emitting elements are connected to intersections of a plurality of data lines and a plurality of scanning lines, sequential scanning is executed by connection of the scanning lines to a scanning reference potential point and a reverse bias voltage for the light-emitting elements is supplied to scanning lines which are not connected to the scanning reference potential point to be in a non-scanning state. The device is characterized in that an operation during which a forward voltage is applied to all the light-emitting elements at least one time and an operation during which a reverse direction voltage is applied to all the light-emitting elements at least one time are executed in a predetermined period, whether light-emitting of the elements is executed or not in the period.

DESCRIPTION OF THE PREFERRED EMBODIMENTS

Figure 3:
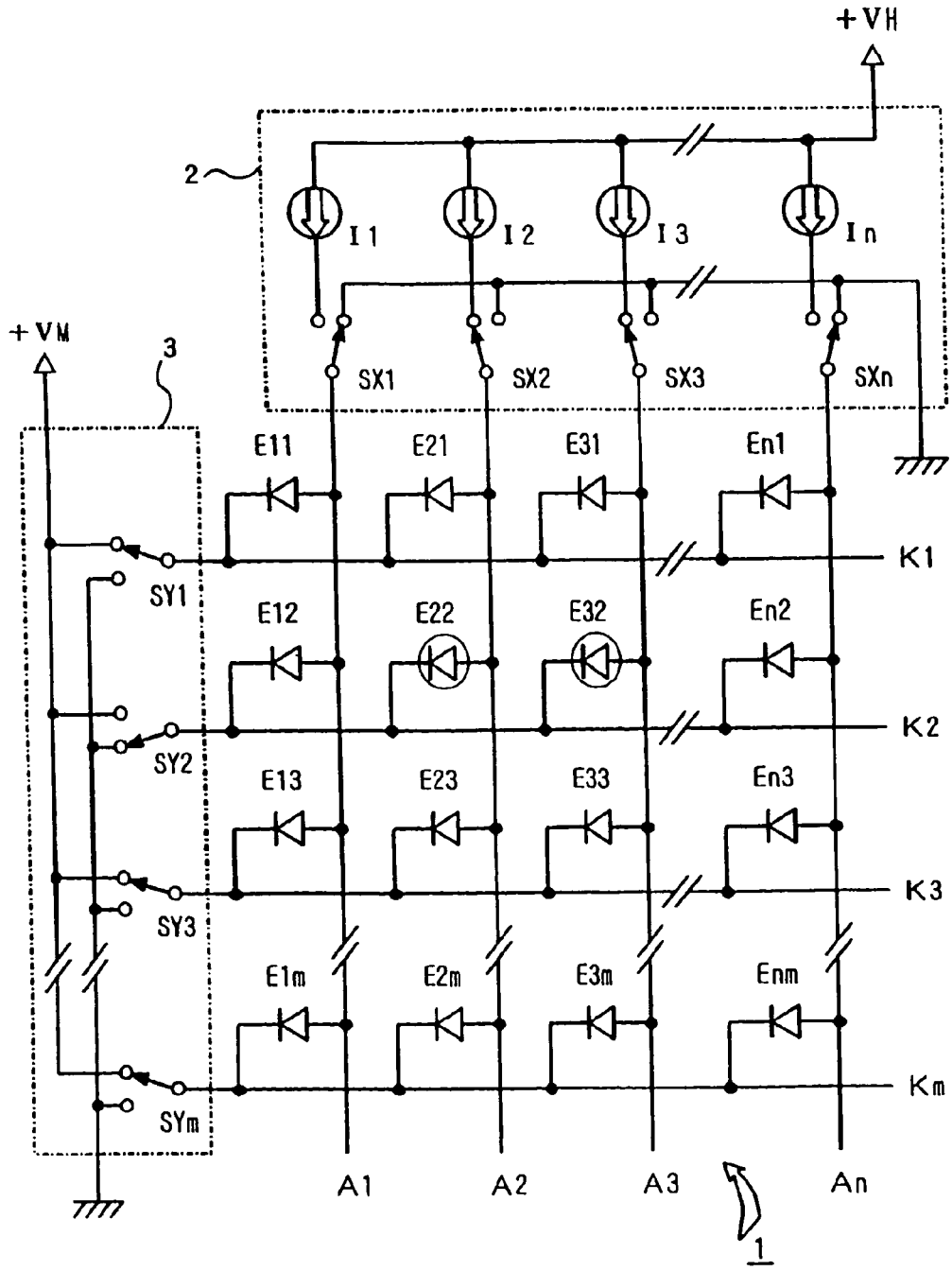
FIG. 3 (Prior Art)
FIG. 3 is a connection diagram showing an example for a conventional passive-drive-type display panel and a drive device therefor.
Figure 4:
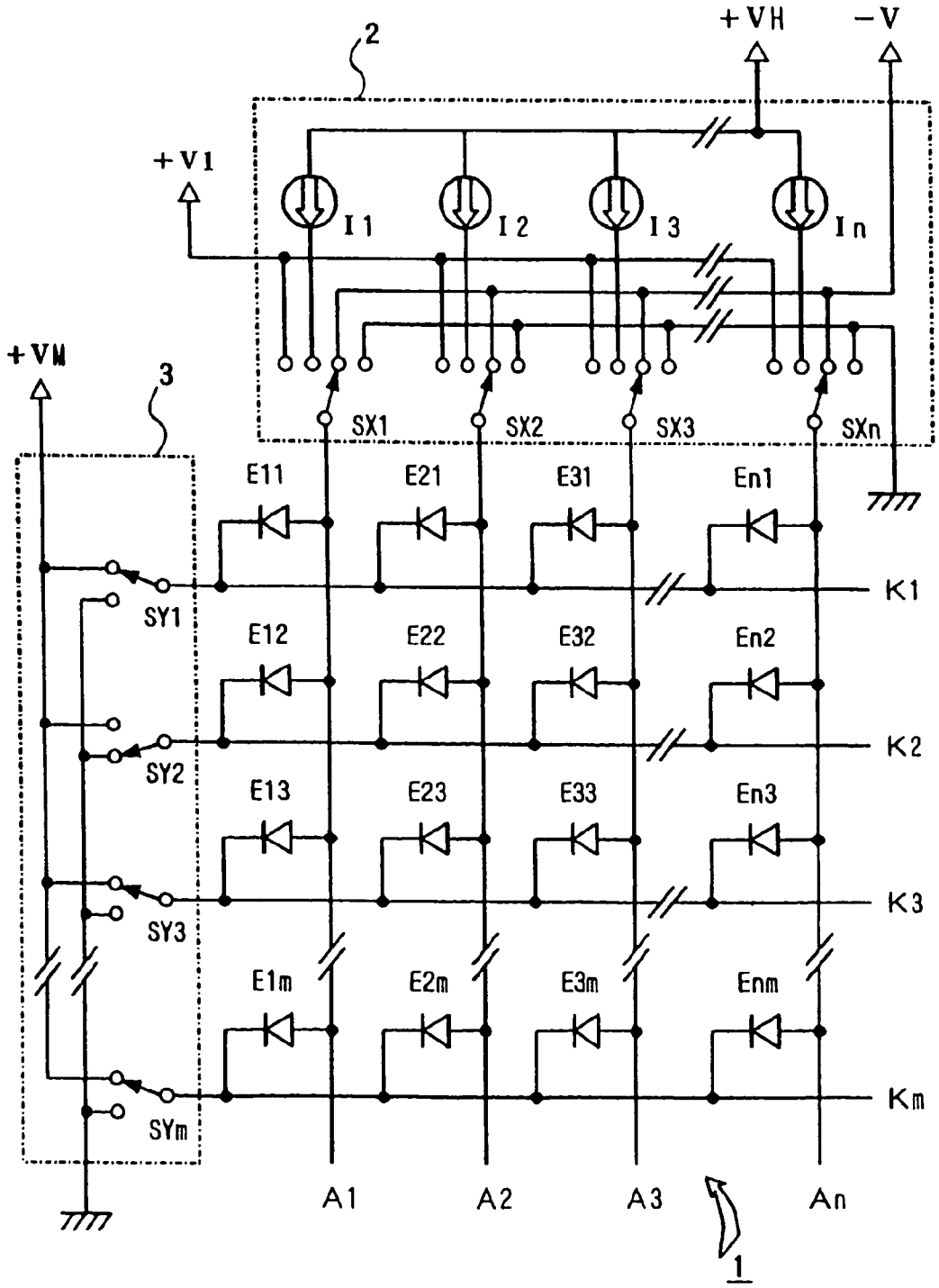
FIG. 4 is a connection diagram showing a first operation state in a first embodiment according to the present invention.
Figure 5:
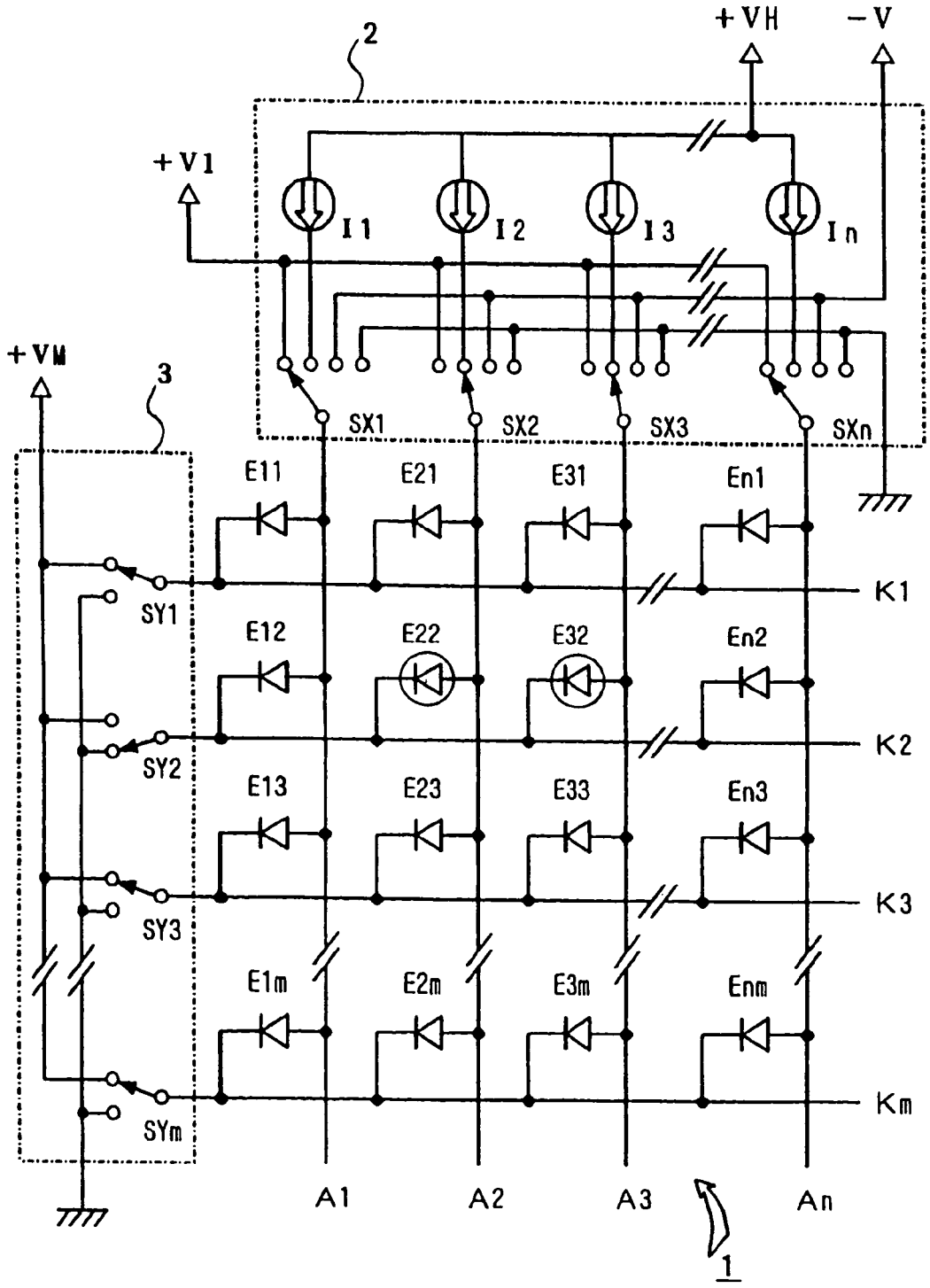
FIG. 5 is a connection diagram showing a second operation state in the first embodiment.
Figure 6:
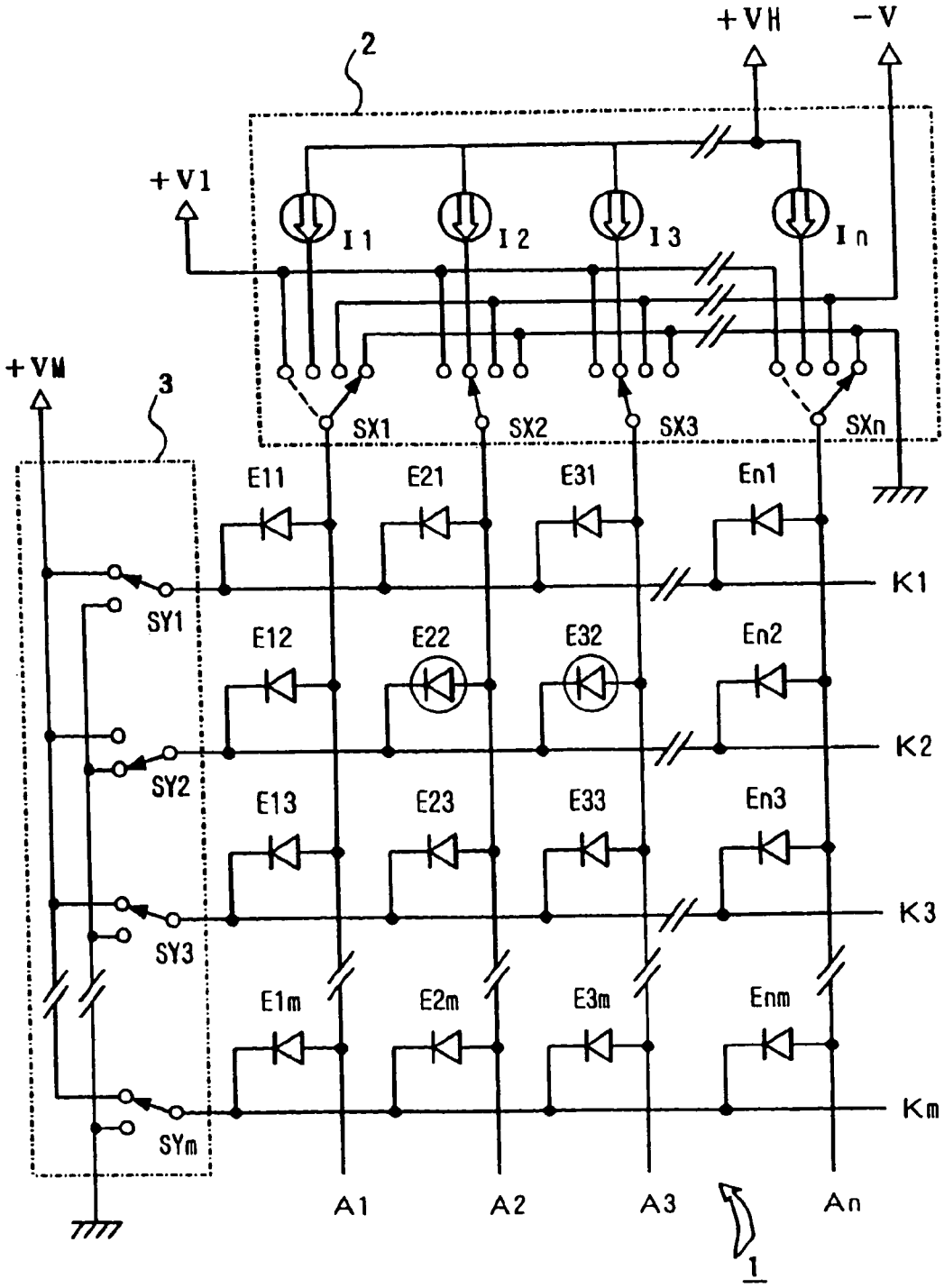
FIG. 6 is a connection diagram showing a third operation state in the first embodiment.

Hereinafter, preferred embodiments of a drive device for a light-emitting display panel according to the invention will be explained, referring to drawings. FIG. 4 to FIG. 6 show a first embodiment. Here, in FIG. 4 to FIG. 6, parts similar to those previously explained with reference to FIG. 3 will be denoted by the same reference numbers as those in FIG. 3, and detailed explanation will be eliminated.

Figure 1:
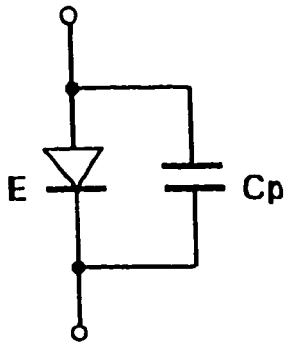
FIG. 1 (Prior Art)
FIG. 1 is a diagram of an equivalent circuit showing an electric configuration of an organic EL element.
Figure 2A:
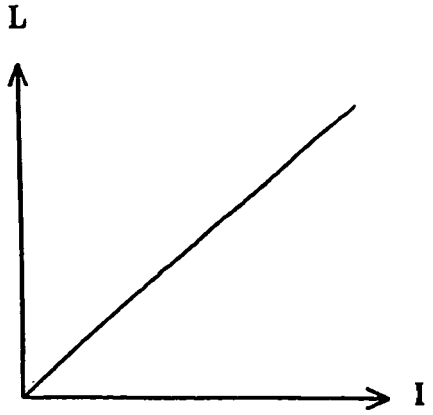
FIG.2A (Prior Art)
FIG. 2A to FIG. 2C are diagrams explaining static characteristics of an organic EL element.
Figure 2B:
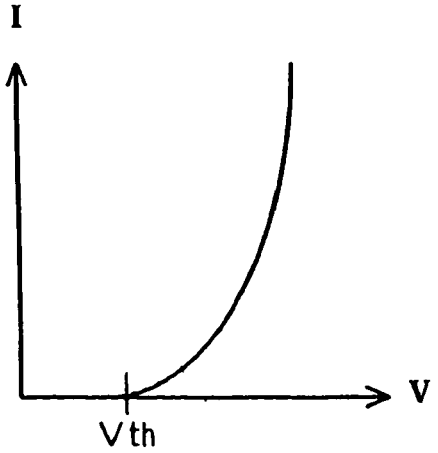
FIG.2B (Prior Art)
Figure 2C:
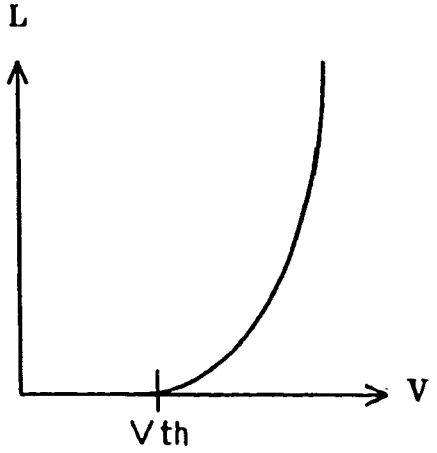
FIG.2C (Prior Art)

In a configuration shown in FIG. 4 to FIG. 6, a difference in the configuration between FIG. 4 to FIG. 6 and FIG. 3 is that drive switches SX1 to SXn in an anode-line drive circuit 2 have a function, respectively, by which a forward voltage +V1 and a reverse direction voltage −V, which are shown in the drawing, as well as constant current sources I1 to In and the ground potential, can be also selected. A positive voltage equal to or less than a light-emitting threshold voltage (Vth) of an EL element is used as the above-described forward voltage +V1, as explained in FIG. 2. Moreover, a negative voltage of several volts is used as the above-described reverse direction voltage −V.

All of FIG. 4 to FIG. 6 show a state in which a second cathode line K2 is scanned, the second cathode line K2 is set at the ground potential through the scanning switch SY2, and a reverse bias voltage +VM is selected for other cathode lines through other scanning switches. Moreover, all the drive switches SX1 to SXn are configured to select the reverse direction voltage −V, as shown in FIG. 4, immediately after the second cathode line K2 starts scanning. Thereby, the reverse direction voltage −V is applied through the drive switches SX1 to SXn and anode lines A1 to An to anodes of EL elements E12, E22, E32, . . . En2, which are in a scanning state.

Subsequently, the drive switches Sx2, Sx3 for the anode lines, corresponding to the EL elements (E22 and E32 enclosed with a circle in FIG. 5) which are to be scanned and for which light emitting is to be performed, are connected to the side of the constant current sources, as shown in FIG. 5. Accordingly, the EL elements of E22 and E32 enclosed with a circle are controlled for light emitting. At this time, the forward voltage +V1 is configured to be applied through the drive switches to anode lines (A1 and An in the drawing) for non light-emitting control. Since the above-described forward voltage +V1 is the positive voltage equal to or less than the light-emitting threshold voltage Vth of the EL element as explained above, the EL elements which are connected to the anode lines under control for non light-emitting and to which the forward voltage +V1 is applied are not put into a light-emitting state.

Thus, the forward voltage is applied to the EL elements under control for light-emitting through currents from the constant current sources as driving power-supplies for light emitting and the forward voltage +V1 is applied to the EL elements under control for non light-emitting. Thereby, an operation during which the reverse direction voltage −V is applied, and an operation during which the forward voltage +V is applied is executed for all the EL elements in this scanning period. Therefore, the light-emitting life of the EL elements can be extended by the above-described configuration.

Subsequently, the drive switches (SX1 and SXn in the drawing) corresponding to the anode lines under control for non light-emitting are configured to be set in such a way that the ground potential is selected as shown in FIG. 6. Thereby, the reverse bias voltage VM can be applied to the EL elements which are connected to intersections of the anode lines under control for light emitting and the cathode lines which have not been selected for scanning to prevent the EL elements from cross-talk light-emitting by leakage currents. Here, the above-described drive switches corresponding to the anode lines under control for non light-emitting may be configured to select not the ground potential but the reverse direction voltage −V at this time.

A series of operations which have been explained above, referring to FIG. 4 to FIG. 6 are completed in one scanning period. A third cathode line K3 starts scanning as the subsequent scanning. Even in this period, similar operations to the above-described ones are performed to execute an operation, by which the reverse direction voltage is applied, or an operation, by which the forward voltage is applied, for all the EL elements. Thereby, the light-emitting life of the EL elements can be extended.

Figure 7:
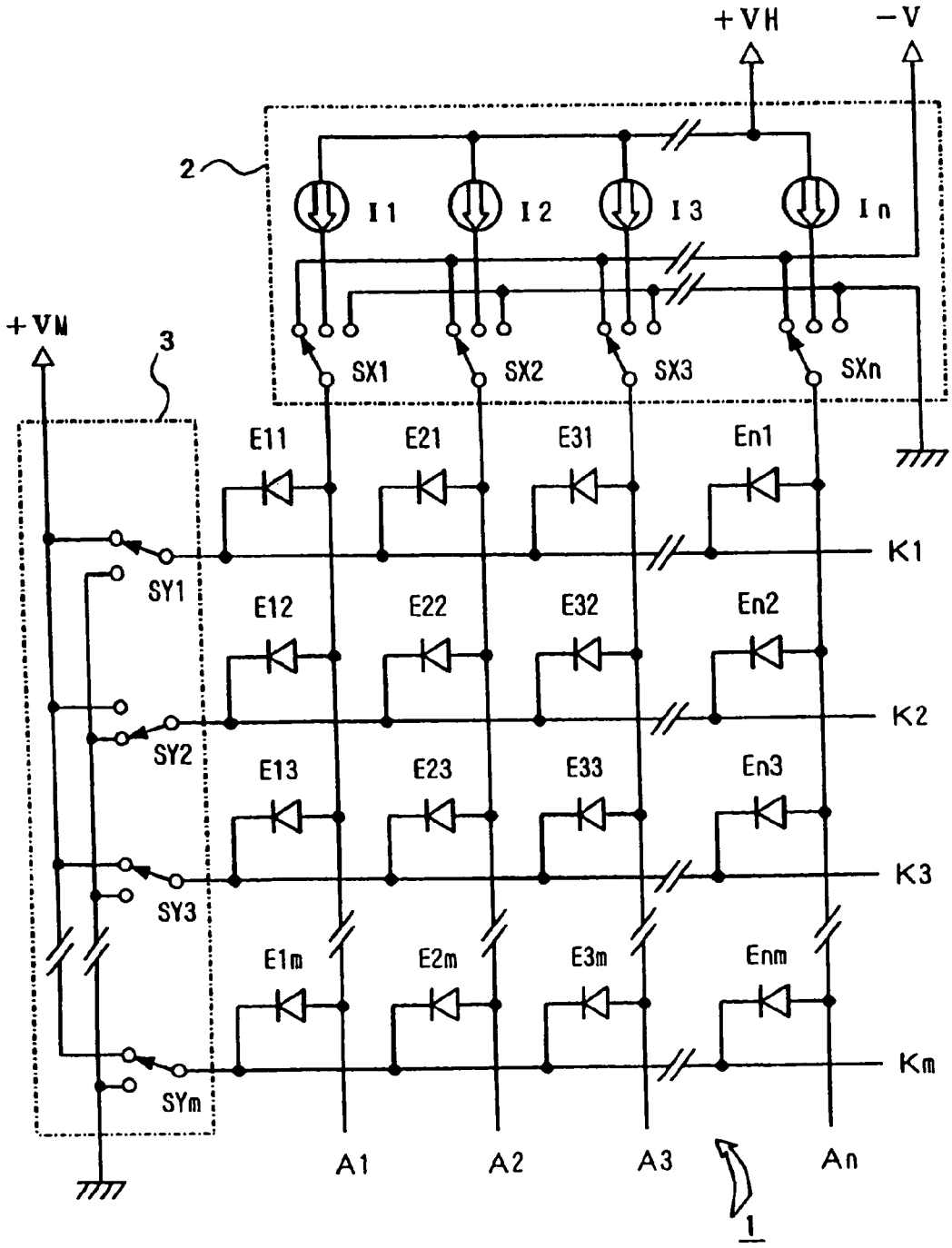
FIG. 7 is a connection diagram showing a first operation state in a second embodiment.
Figure 8:
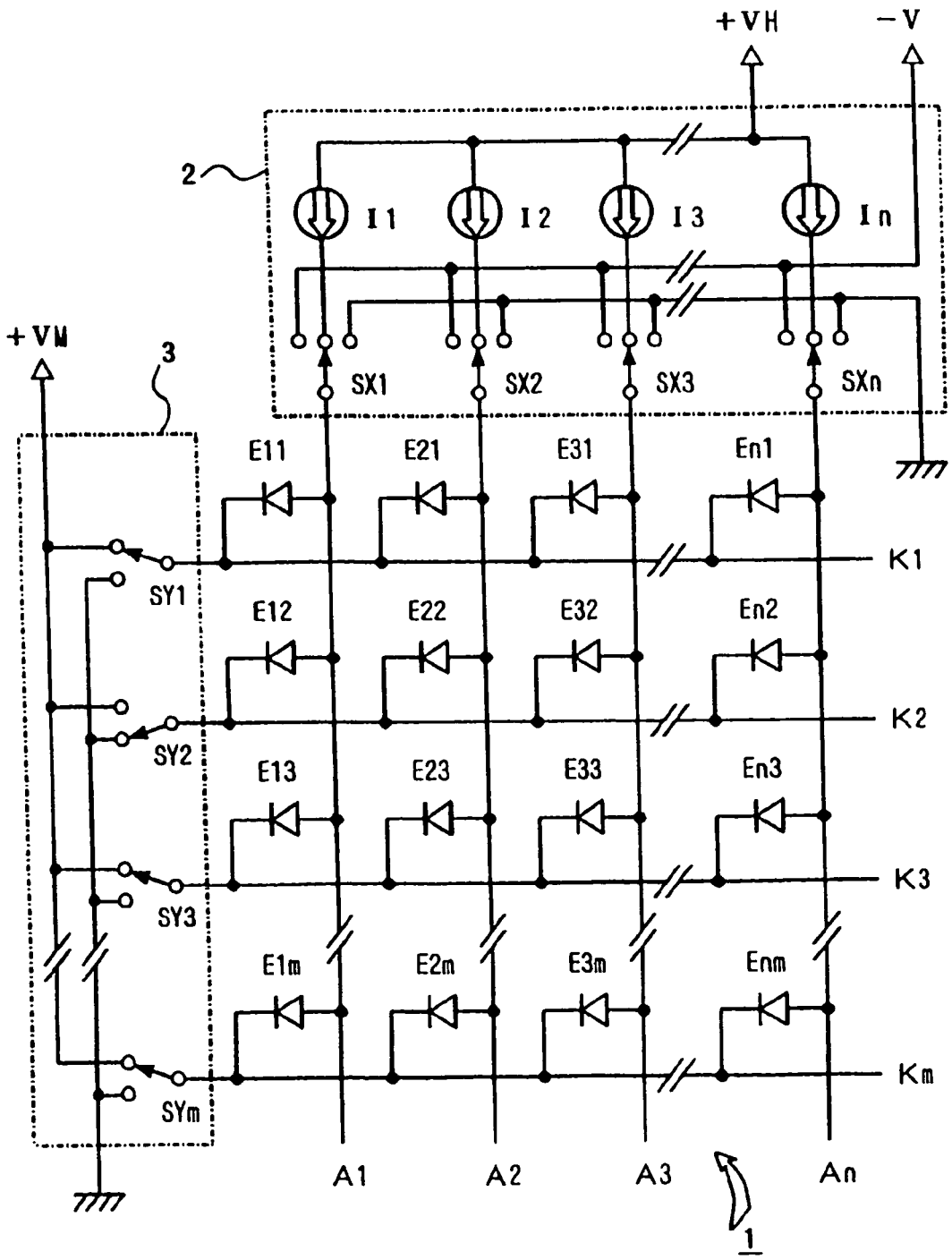
FIG. 8 is a connection diagram showing a second operation state in the second embodiment.
Figure 9:
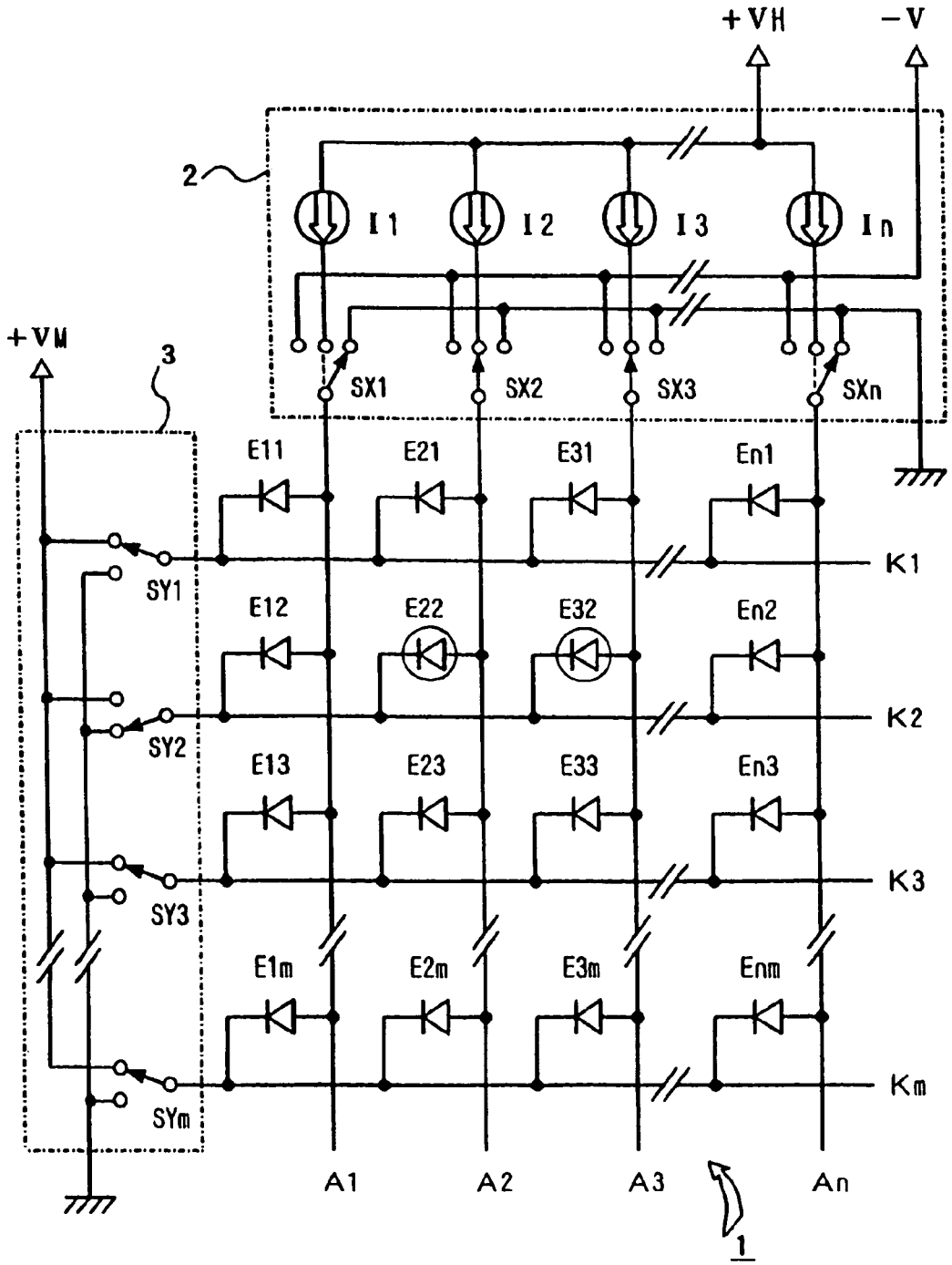
FIG. 9 is a connection diagram showing a third operation state in the second embodiment.

Then, FIG. 7 to FIG. 9 show a second embodiment. Here, even in FIG. 7 to FIG. 9, parts similar to those previously explained with reference to FIG. 3 will be denoted by the same reference numbers as those in FIG. 3, and detailed explanation will be eliminated.

In a configuration shown in FIG. 7 to FIG. 9, a difference in the configuration between FIG. 7 to FIG. 9 and FIG. 3 is that drive switches SX1 to Sxn in an anode-line drive circuit 2 have a function, respectively, by which a reverse direction voltage −V, which are shown in the drawing, as well as constant current sources I1 to In and the ground potential, can be also selected. Moreover, a negative voltage of several volts is used as the reverse direction voltage −V in a similar manner to that of the embodiment shown in FIG. 4 to FIG. 6.

All of FIG. 7 to FIG. 9 show a case in which a second cathode line K2 is scanned, the second cathode line K2 is set at the ground potential through a scanning switch SY2, and a reverse bias voltage +VM is selected for other cathode lines through other scanning switches. Moreover, all the drive switches SX1 to SXn are configured to select the reverse direction voltage −V, as shown in FIG. 7, immediately after the second cathode line K2 starts scanning. Thereby, the reverse direction voltage −V is applied through the drive switches SX1 to SXn and anode lines A1 to An to anodes of EL elements E12, E22, E32, . . . En2, which are in a scanning state.

Subsequently, all the drive switches SX1 to SXn are connected to the constant current sources I1 to In as driving power-supplies for the EL elements, respectively. The above-described connected state is completed instantly to execute the subsequent operation, that is, the drive switches Sx2, SX3 for the anode lines, corresponding to the EL elements which are to be scanned and for which light emitting is to be performed, are connected to the side of the constant current sources as it is, and other drive switches are configured to be set in such a way that the ground potential is selected as shown in FIG.9. Accordingly, the EL elements which are enclosed with a circle and are to be scanned, and for which light emitting is to be performed are put into a state in which the elements are controlled for light emitting by driving currents from the above-described constant current sources.

On the other hand, the momentary currents from the constant current sources are supplied to the EL elements for which light emitting is not to be performed, and the elements are put into a forward bias state. But, the above state is momentary and, under such a state, the forward voltages by the driving currents which cause the EL elements not to perform light emitting, that is, which does not contribute to light emitting are applied to the elements.

Therefore, the forward voltages are applied to the EL elements, which are controlled for light emitting, by the currents from the constant current sources as the driving power-supplies for the EL elements, and the forward voltages are applied to the EL elements, which are controlled for non light-emitting, by the momentary currents supplied from the constant current sources. Thereby, an operation during which the reverse direction voltage is applied, and an operation during which the forward voltage is applied is executed for all the EL elements in this scanning period. Therefore, the light-emitting life of the EL elements can be extended by the above-described configuration.

Here, even in the embodiment shown in FIG. 7 through FIG. 9, the drive switches (SX1 and SXn in the drawing) corresponding to the anode lines which are controlled for non light emitting are configured to be set in such a way that the ground potential is selected as shown in FIG. 9. Thereby, the reverse bias voltage VM can be applied to the EL elements which are connected to intersections of the anode lines under control for light emitting and the cathode lines which have not been selected for scanning to prevent the EL elements from cross-talk light-emitting by leakage currents. Here, the above-described drive switches corresponding to the anode lines under control for non light-emitting may be configured to select not the ground potential but the reverse direction voltage −V.

A series of operations which have been explained above, referring to FIG. 7 to FIG. 9 are completed in one scanning period. Even in a case in which scanning of a third cathode line K3 is performed as the subsequent scanning, similar operations to the above-described ones are performed to execute an operation, by which the reverse direction voltage is applied, or an operation, by which the forward voltage is applied, for all the EL elements. Thereby, the light-emitting life of the EL elements can be extended.

Figure 10:
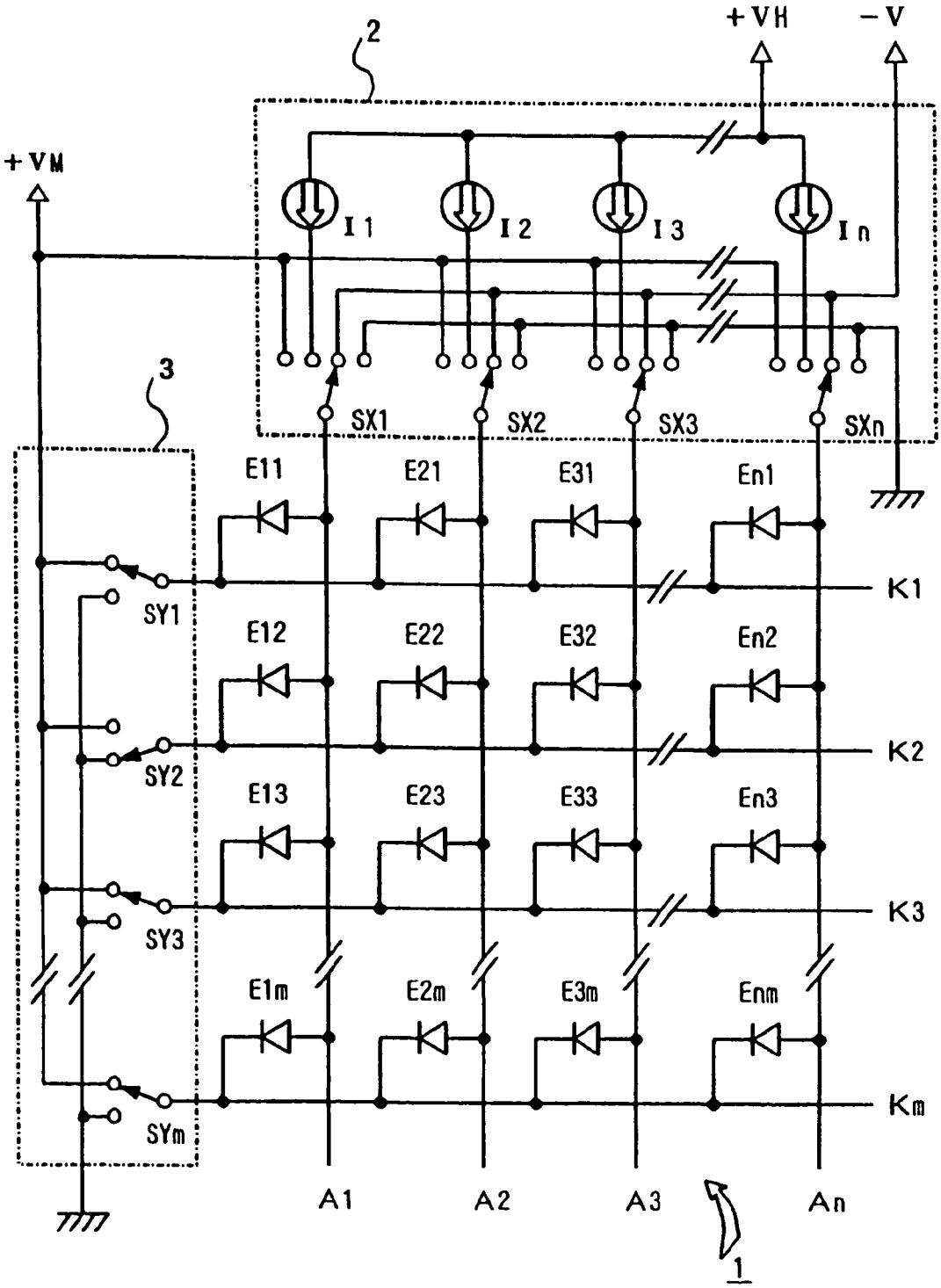
FIG. 10 is a connection diagram showing a first operation state in a third embodiment.
Figure 11:
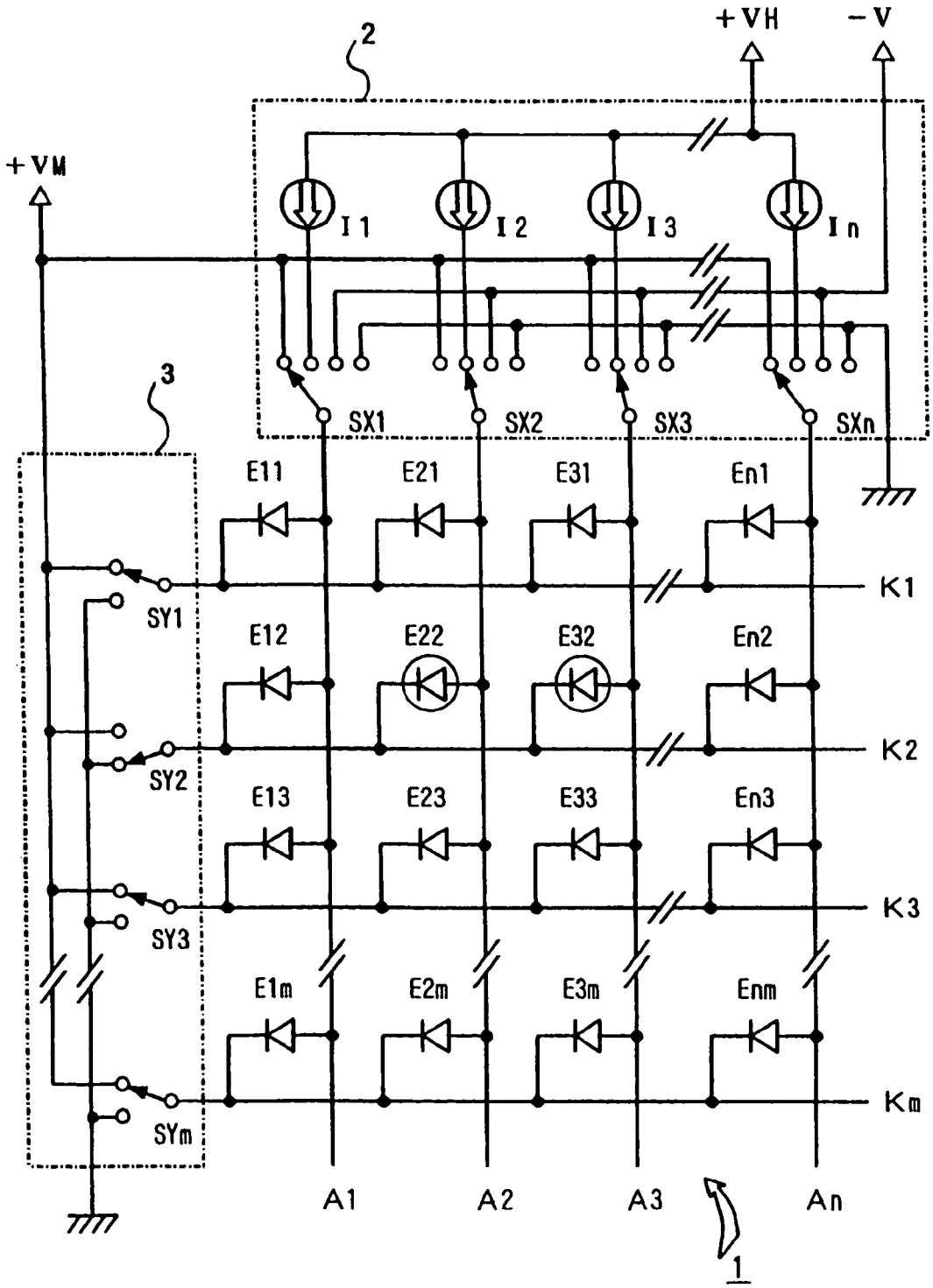
FIG. 11 is a connection diagram showing a second operation state in the third embodiment.
Figure 12:
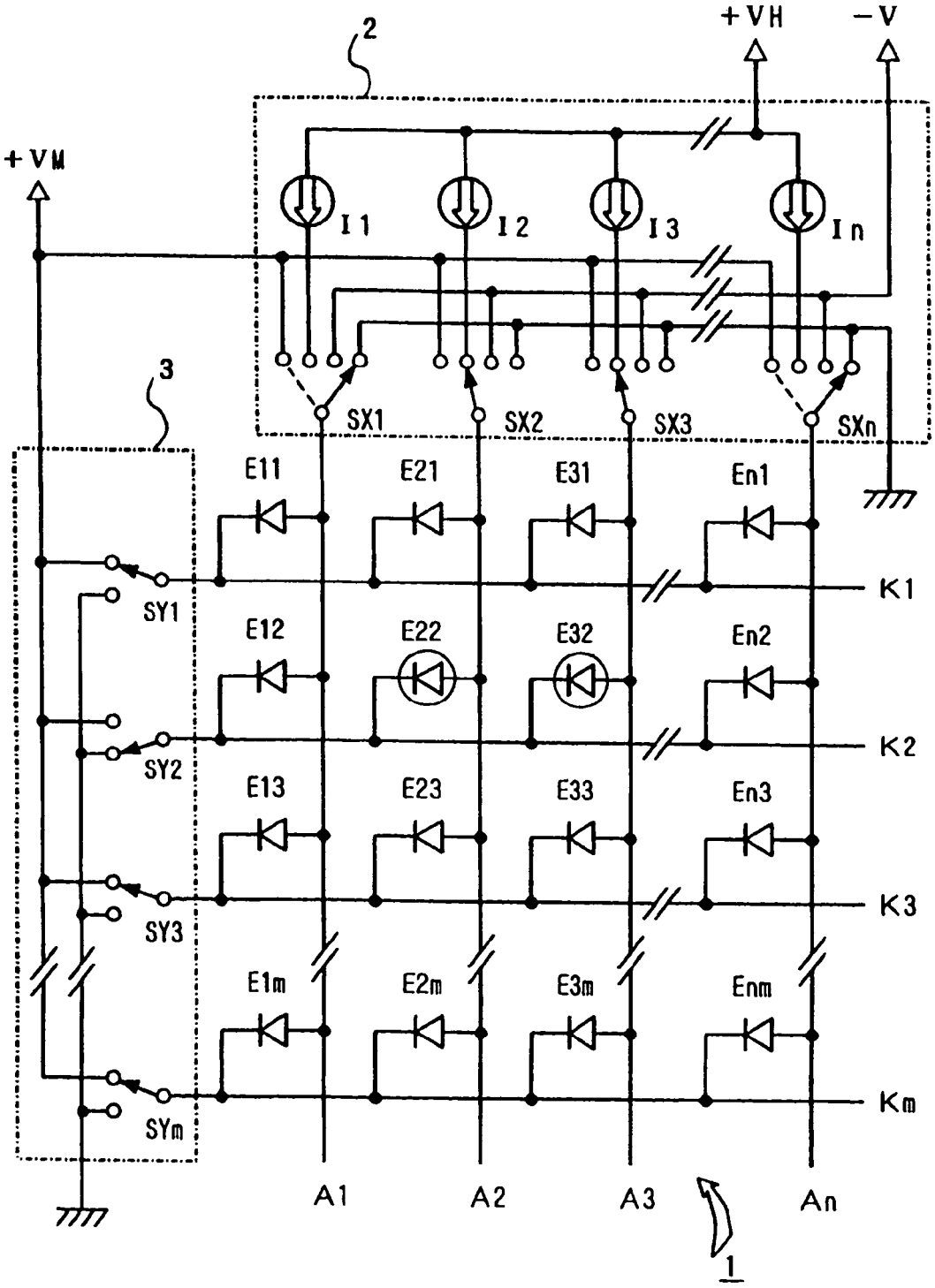
FIG. 12 is a connection diagram showing a third operation state in the third embodiment.

Then, FIG. 10 to FIG. 12 show a third embodiment. Here, in a configuration in the embodiment shown in FIG. 10 to FIG. 12, only one difference in the configuration between the embodiment shown in FIG. 10 to FIG. 12 and that shown in FIG. 4 to FIG. 6 which has been already explained is that a reverse bias voltage VM used in a cathode-line scanning circuit 3, instead of a forward voltage +V1, is used as the forward voltage. Accordingly, parts similar to those previously explained with reference to the previous embodiment will be denoted by the same reference numbers as those in the previous embodiment, and detailed explanation will be eliminated.

All of FIG. 10 to FIG. 12 show a case in which a second cathode line K2 is scanned, the second cathode line K2 is set at the ground potential through a scanning switch SY2, and a reverse bias voltage +VM is selected for other cathode lines through other scanning switches. Moreover, all the drive switches SX1 to SXn are configured to select a reverse direction voltage −V, as shown in FIG. 10, immediately after the second cathode line K2 starts scanning. Thereby, the reverse direction voltage −V is applied through the drive switches SX1 to SXn and anode lines A1 to An to anodes of all EL elements E12, E22, E32, . . . En2, which are in a scanning state.

Subsequently, the drive switches SX2, SX3 for the anode lines, corresponding to the EL elements (E22 and E32 enclosed with a circle in FIG. 11) which are to be scanned and for which light emitting is to be performed, are connected to the side of the constant current sources, as shown in FIG. 11. Accordingly, the EL elements of E22 and E32 enclosed with the circle are controlled for light emitting. At this time, the reverse bias voltage +VM is selected through the drive switches and is applied as the forward voltage to anode lines (A1 and An in the drawing) for non light-emitting control.

The reverse bias voltage +VM as the above-described forward voltage is approximately equal to a forward voltage Vf of an EL element in a light-emitting state and is larger than a light-emitting threshold voltage of the EL element as already explained above. Accordingly, drive switches (SX1 and SXn in FIG. 12) other than the drive switches for the anode lines, corresponding to the EL elements which are to be scanned and for which light emitting is to be performed, are configured to be set in such a way that the ground potential is instantly selected as shown in FIG. 12. Accordingly, the EL elements which are to be scanned, and for which light emitting is to be performed are put into a state in which the elements are controlled for light emitting by driving currents from the above-described constant current sources.

On the other hand, the momentary reverse bias voltage +VM is supplied in the forward direction to the EL elements for which light emitting is not to be performed, as described above. Thereby, the elements are put into a state, in which the forward voltage is applied. But, since this time is momentary as described above, light emitting of the EL elements can not be realized. That is, the forward voltages are supplied to the EL elements so that the voltages can not contribute to light emitting.

Therefore, the forward voltages are applied to the EL elements, which are controlled for light emitting, by the currents from the constant current sources as the driving power-supplies for the EL elements, and the momentary forward voltages using the above-described reverse bias voltage +VM are applied to the EL elements which are controlled for non light-emitting. Thereby, an operation during which the reverse direction voltage is applied, and an operation during which the forward voltage is applied is executed for all the EL elements in this scanning period. Therefore, the light-emitting life of the EL elements can be extended by the above-described configuration.

Here, even in the embodiment shown in FIG. 10 to FIG. 12, the drive switches (SX1 and SXn in the drawing) corresponding to the anode lines which are controlled for non light-emitting are configured to be set in such a way that the ground potential is selected as shown in FIG. 12. Thereby, the reverse bias voltage VM can be applied to the EL elements which are connected to intersections of the anode lines under control for light emitting and the cathode lines which have not been selected for scanning to prevent the EL elements from cross-talk light-emitting by leakage currents. Here, the above-described drive switches corresponding to the anode lines under control for non light-emitting may be configured to select not the ground potential but the reverse direction voltage −V.

A series of operations which have been explained above, referring to FIG. 10 to FIG. 12 are completed in one scanning period. Even in a case in which scanning of a third cathode line K3 is performed as the subsequent scanning, similar operations to the above-described ones are performed to execute an operation, by which the reverse direction voltage is applied, or an operation, by which the forward voltage is applied, for all the EL elements. Thereby, the light-emitting life of the EL elements can be extended. Here, not only the above-described reverse bias voltage +VM, but also a voltage by another voltage source may be used as the forward voltage, though the momentary forward voltages using the reverse bias voltage +VM are applied to the EL elements which are controlled for non light-emitting in the embodiment shown in FIG. 10 to FIG. 12.

Though application of the reverse direction voltage, or that of the forward voltage is executed for all the EL elements every one scanning period in all the embodiments which have been explained above, the above operation may be executed, for example, every one frame period. Preferably, a dummy scanning mode is set between completion of the last scanning of, for example, one frame and beginning of scanning of the first cathode line for display of the subsequent frame in order to execute the above operation. A period for the dummy scanning mode may be equal to, shorter than, or longer than the period for scanning each cathode line.

In the dummy scanning mode, all the scanning switches SY1 to SYm, in the first place, select the ground potential as the scanning reference point in the embodiment shown in FIG. 4 to FIG. 6. That is, under a state in which all the scanning switches SY1 to SYm, which are shown in FIG. 4, select the ground potential, all the drive switches SX1 to SXn are connected to the side of the reverse direction voltage −V, as shown in FIG. 4. Thereby, the reverse direction voltage −V can be simultaneously applied to all the EL elements.

Subsequently, under a state in which all the scanning switches SY1 to SYm select the ground potential, all the drive switches SX1 to SXn, which are shown in FIG. 5, select the reverse direction voltage +V1. Thereby, the reverse direction voltage +V can be simultaneously applied to all the EL elements. As already explained above, the above-described forward voltage +V1 is set lower than the threshold voltage of the EL element. Accordingly, the EL element does not emit light even if the forward voltage +V1 is applied. After the above-described forward voltage +V1 is applied, all the drive switches SX1 to SXn which are in a state shown in FIG. 6 are configured to select the ground potential and the dummy scanning mode is completed.

According to the above-described dummy scanning mode, the reverse direction voltage −V can be simultaneously applied to all the EL elements or the reverse direction voltage +V1 can be applied at the same time to all the EL elements every one frame period. Thereby, the light-emitting life of the EL elements can be extended.

Then, another example for the dummy scanning mode which is set every one frame period will be explained, referring to FIG. 7 to FIG. 9. In the another example for the dummy scanning mode, all the scanning switches SY1 through SYm, in the first place, select the ground potential as the scanning reference potential point in the embodiment shown in FIG. 7. That is, under a state in which all the scanning switches SY1 to SYm, which are shown in FIG. 7, select the ground potential, all the drive switches SX1 to SXn are connected to the side of the reverse direction voltage −V, as shown in FIG. 7. Thereby, the reverse direction voltage −V can be simultaneously applied to all the EL elements.

Subsequently, under a state in which all the scanning switches SY1 to SYm select the ground potential, all the drive switches SX1 to SXn, which are shown in FIG. 8, are connected to the side of to the constant current sources I1 to In. Thereby, the currents from the constant current sources can be simultaneously supplied to all the EL elements, and the forward voltage can be simultaneously applied to all the EL elements. Instantly after the above-described drive switches are connected to the side of the constant current sources, all the drive switches SX1 to SXn, which are shown in FIG. 9, are connected to the ground potential and the dummy scanning mode is completed.

The driving currents from the constant current sources I1 to In are supplied to all the EL elements by momentary connection of the above-described drive switches SX1 to SXn to the side of the constant current sources I1 to In, and the elements are put into a forward bias state. But, under such a state, the forward voltages by the momentary driving currents which cause the EL elements not to perform light emitting, that is, which does not contribute to light emitting are applied to the elements.

According to the above-described dummy scanning mode, the reverse direction voltage −V can be simultaneously applied to all the EL elements or the forward voltage +V1 can be applied at the same time to all the EL elements every one frame period. Thereby, the light-emitting life of the EL elements can be extended.

Then, further another example for the dummy scanning mode which is set every one frame period will be explained, referring to FIG. 10 to FIG. 12. In the further another example for the dummy scanning mode, all the scanning switches SY1 through SYm, in the first place, select the ground potential as the scanning reference potential point in the embodiment shown in FIG. 10. Under such a state, all the drive switches SX1 to SXn are connected to the side of the reverse direction voltage −V, as shown in FIG. 10. Thereby, the reverse direction voltage −V can be simultaneously applied to all the EL elements.

Subsequently, under a state in which all the scanning switches SY1 to SYm select the ground potential, all the drive switches SX1 to SXn, which are shown in FIG. 11, select the reverse bias voltage +VM to apply the forward voltage to all the EL elements. The reverse bias voltage +VM is approximately equal to a forward voltage Vf of the EL element in a light-emitting state and is larger than a light-emitting threshold voltage of the EL element as already explained above. Accordingly, all the drive switches SX1 to SXn, which are shown in FIG. 12, are connected to select the ground voltage to complete the dummy scanning mode immediately after the drive switches SX1 to SXn select the reverse bias voltage +VM.

According to the embodiment which has been explained above, referring to FIG. 10 to FIG. 12, the momentary reverse bias voltage +VM is supplied in the forward direction to the EL elements. Thereby, the elements are put into a state, in which the forward voltage is applied. But, since this time is momentary as described above, light emitting of the EL elements can not be realized. That is, the forward voltages are supplied to the EL elements so that the voltages can not contribute to light emitting.

Even in the above-described dummy scanning mode based on FIG. 10 to FIG. 12, the reverse direction voltage −V can be simultaneously applied to all the EL elements or the reverse direction voltage can be applied at the same time to all the EL elements everyone frame period. Thereby, the light-emitting life of the EL elements can be extended.

Though the period of the dummy scanning mode has been set, for example, at the end of one frame scanning according to the examples which have been explained above, there may be a configuration in which the above-described period of the dummy scanning mode is set every scanning of a plurality of frames, for example, every scanning of about ten frames to apply the reverse direction voltage or the forward voltage to all the EL elements as described above.

What is claimed is:

1. A drive device for a light-emitting display panel comprising:

a plurality of data lines;

a plurality of scanning lines intersecting the data lines;

light-emitting elements connected to intersections of the plurality of data lines and the plurality of scanning lines; and a scanning reference potential point, wherein sequential scanning is executed by connection of the scanning lines to the scanning reference potential point and a reverse bias voltage for the light-emitting elements is supplied to scanning lines which are not connected to the scanning reference potential point to be in a non-scanning state, and wherein an operation, during which a forward voltage is applied to all the data lines at least one time and an operation during which a reverse direction voltage is applied to all the data lines at least one time, is executed during a predetermined scanning period, whether light-emitting of the elements is executed or not in the predetermined scanning period.

2. The drive device for a light-emitting display panel according to claim 1, wherein the predetermined period is one scanning period, and an operation during which a reverse direction voltage is applied to light-emitting elements connected to selected scanning lines and an operation during which a forward voltage, which does not contribute to light emitting, is applied to data lines under control for non light-emitting are executed in the one scanning period.

3. The drive device for a light-emitting display panel according to claim 1, wherein the predetermined period is one frame period, a dummy scanning mode is set in the one frame period, and an operation during which a reverse direction voltage is applied to all light-emitting elements and an operation during which a forward voltage, which does not contribute to light emitting, is applied to all light-emitting elements are executed during the dummy scanning mode.

4. The drive device for a light-emitting display panel according to claim 1, wherein the predetermined period is a period longer than one frame, a dummy scanning mode is set in the period, and an operation during which a reverse direction voltage is applied to all light-emitting elements and an operation during which a forward voltage, which does not contribute to light emitting, is applied to all light emitting elements are executed during the dummy scanning mode.

5. The drive device for a light-emitting display panel according to any one of claims 2 to 4, wherein the forward voltage which does not contribute to light emitting is a forward voltage equal to or smaller than a light-emitting threshold voltage of a light-emitting element.

6. The drive device for a light-emitting display panel according to any one of claims 2 to 4, wherein the forward voltage which does not contribute to light emitting is applied so that currents for lighting driving of light-emitting elements from a driving power supply are supplied in a short time.

7. The drive device for a light-emitting display panel according to any one of claims 2 to 4, wherein the forward voltage which does not contribute to light emitting is applied so that a voltage from a voltage source having equal to or larger than a light-emitting threshold voltage of a light-emitting element are supplied in a short time.

8. The drive device for a light-emitting display panel according to claim 7, wherein the voltage source having equal to or larger than the light-emitting threshold voltage of a light-emitting element is the reverse-bias-voltage source by which a reverse bias voltage is supplied to light-emitting elements in a non-scanning state.

9. The drive device for a light-emitting display panel according to any one of claims 1 to 4, wherein the light-emitting element comprises an organic EL element using an organic compound for a light-emitting layer.

10. The drive device for a light-emitting display panel according to claim 5, wherein the light-emitting element comprises an organic EL element using an organic compound for a light-emitting layer.

11. The drive device for a light-emitting display panel according to claim 6, wherein the light-emitting element comprises an organic EL element using an organic compound for a light-emitting layer.

12. The drive device for a light-emitting display panel according to claim 7, wherein the light-emitting element comprises an organic EL element using an organic compound for a light-emitting layer.

13. The drive device for a light-emitting display panel according to claim 8, wherein the light-emitting element comprises an organic EL element using an organic compound for a light-emitting layer.

* * * * *